United States Patent [19]

Wahl

[11] Patent Number: 4,822,690

[45] **Date of Patent: * Apr. 18, 1989**

[54] VIOLIN FINISH AND FINISHING METHOD

[76] Inventor: Eugene A. Wahl, 460 Ridgewood Ave., Glen Ridge, N.J. 07028

[ * ] Notice: The portion of the term of this patent subsequent to Dec. 6, 2005 has been disclaimed.

[21] Appl. No.: 256,717

[22] Filed: Oct. 12, 1988

Related U.S. Application Data

[63] Continuation-in-part of Ser. No. 114,573, Oct. 29, 1987, Pat. No. 4,789,603.

[51] Int. Cl.[4] ..... G10D 1/02

[52] U.S. Cl. ..... 428/498; 428/537.1

[58] Field of Search ..... 428/498, 537.1; 84/275

[56] References Cited

U.S. PATENT DOCUMENTS 1,972,502 9/1934 Tuchfarber ..... 428/498

4,364,990 12/1982 Haines ..... 428/406

*Primary Examiner*—Edith Buffalow

*Attorney, Agent, or Firm*—Anthony J. Casella; Gerald E. Hespos

[57] ABSTRACT

A violin and a method for finishing a violin are provided. The violin comprises a plurality of coats of an alcohol based finish having a dye dissolved therein applied to the violin. At least one coat of a spirit based finish and preferably varnish is applied over the alcohol based finish coats. The interior of the violin may also be coated with one or more coats of alcohol or oil based finish.

23 Claims, 1 Drawing Sheet

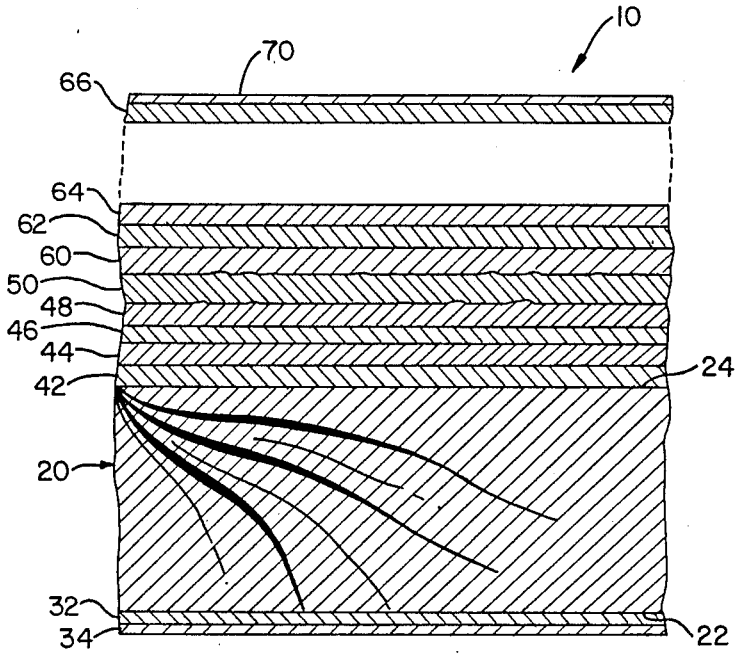
10
70
66
64
62
60
50
48
46
44
42
24
20
32
34
22

VIOLIN FINISH AND FINISHING METHOD

RELATED APPLICATIONS

This application is a continuation-in-part of U.S. patent application Ser. No. 114,573 which was filed on Oct. 29, 1987, now U.S. Pat. No. 4789603.

BACKGROUND OF THE INVENTION

Bow played string instruments are known to have existed for approximately five thousand years, as evidenced by the Ravanastron of ancient India. Bow played string instruments evolved over the centuries, and are known to have existed in one form or another at various places in Asia, Europe and Africa.

The violin, in substantially its current structural form, is believed to have originated in Brescia, Italy, in the sixteenth century. Gasparo da Salo who lived from approximately 1555 to approximately 1610 is often credited with being the father of the current violin and of the Brescian school of violin making. The most famous violins originated in Cremona, Italy, beginning in the late sixteenth century and extending into the eighteenth century. The Cremona school of violin making is believed to have been started by Andreas Amati who lived from approximately 1520 to approximately 1580. The violin making techniques of Andreas Amati were passed to his sons Anthony and Jerome Amati and then to Jerome's son Nicholas Amati who was born in 1596 and died in 1684. The art of violin making improved through these generations, and the violins of Nicholas Amati were widely known and valued in Europe in his lifetime. The pupils or apprentices of Nicholas Amati included such famous violin makers as Andrew Guarnerius (1630–1695) and Antonio Stradivari (1644–1737) who is widely acknowledged as the greatest violin maker of all time. The Cremona violins of the seventeenth and eighteenth centuries, and particularly the violins of Stradivari have increased substantially in value since they were made. Violins that were sold originally by Stradivari for the equivalent of $20–$50 now command prices of $500,000–$1,000,000.

The increasing value of the violins made by the Cremona masters such as Stradivari is largely attributable to the enduring quality of those instruments. In particular, the violins crafted by Stradivari and other Cremona masters are widely acknowledged for their superior tonal qualities, and their brilliantly lustrous finish which have lasted for the 200–300 year lives of the instruments.

Despite the many volumes written on the secrets of the Cremona violin masters, much of their violin making is truly a lost art. In particular, although violin makers and craftsmen have been able to produce violins dimensionally identical to the Stradivari violins, craftsmen have been unable to learn or duplicate the secrets of the tone and the finish of the violins associated with Stradivari and the other Cremona masters. It is reported that Stradivari had maintained a written record of his finishing secrets, and had kept this record hidden in a family Bible. After the death of Antonio Stradivari in 1737, the secret document was discovered by his son who promptly destroyed the document to ensure that his father's art could never be duplicated.

It is generally acknowledged that the finish applied to the violin affects both the appearance and the tone of the instrument. Hill et al in their work entitled "Antonio Stradivari His Life and His Work (1644–1737)" explained that: "It should be remembered that a violin must vibrate freely, yet not too freely, as would be the case with a newly unvarnished instrument when first in use. Clothe it too thickly with even a good varnish, and the tone will be deadened, or with one too hard in texture, and the result will be that the tone will prove hard and metallic. Or again, cover it with a too soft oil varnish, and you will mute the tone of your instrument for a generation, if not forever."

Many attempts have been made to explain the lost art of Cremona violin finishes and to develop new finishes that approach the tonal qualities and appearances of the Cremona violins. Hill et al, in their above identified work, hypothesized that Stradivari merely employed available oil-based varnishes and that the superior visual and tonal results are attributable to the master's fine hand and application techniques. The patent literature includes several complex attempts to define a finish which yields visual and acoustical results comparable to the old Cremona violins. For example, U.S. Pat. No. 1,083,510 which issued to Tietgen on Jan. 6, 1914 indicates that the violin should receive two coats of a solution formed initially with nine parts alcohol, three parts nitric acid and six parts turpentine. The solution is allowed to stand at least six months until crystals form on the bottom. The remaining liquid is decanted and then added to a solution of three parts gum mastic and nine parts turpentine. After two coats of the resulting finish are applied to the violin, the instrument is dried for six days, after which a coat of commercial nitric acid is applied. Additional coats of hot varnish are then applied to the violin, with still additional coats of alcohol applied to selected parts of the instrument.

U.S. Pat. No. 1,234,989 issued to Wickstrom on July 31, 1917, and suggests that the most desirable coating is achieved by ensuring that the varnish does not become intimately connected to the instrument. To achieve this end, U.S. Pat. No. 1,234,989 teaches an initial coating of hot beeswax. Excess beeswax is rubbed off, and the instrument is next coated with plural layers of a mastic dissolved in alcohol. The reference teaches that the mastic layer will not adhere to the beeswax, and as a result, the substrate consisting of the wood and the beeswax can vibrate free of the top coats.

U.S. Pat. No. 1,622,484 which issued to Bamberger on Mar. 29, 1927 suggests finishing the violin with any available coating material such as shellac, varnish, lacquer or the like that has been treated with a fruit or vegetable juice, and preferably onion juice.

U.S. Pat. No. 1,836,089 issued to Schweitzer on Dec. 15, 1931 and suggests that the varnish employed on the violin body has little effect on the tone of the instrument, and further suggests that the treatment of the sounding board with ultraviolet rays is the secret to enhanced acoustics of the Italian violins. On the other hand, U.S. Pat. No. 856,533 which issued to Lawrence on June 11, 1907 suggests that the enhanced tone is achieved by treating the interior of the violin with a composition consisting of alcohol, gum of guaiac, orange peels and ether.

U.S. Pat. No. 4,252,863 which issued to Song on Feb. 24, 1981 suggests that the desirable tones are achieved by treating the wood of the violin with heat for one to two months, coating the treated violin with iodine, and subsequently heating the violin again at 300° F. for from two to seven days. The wood is then scraped and coated with an undefined varnish material.

The non-patent literature also is replete with divergent examples of the ideal way to treat and/or coat a violin. A typical example is an article dated Oct. 29, 1917 in the "Music Trades" publication which reports that the violin is coated with a combination of varnish, Chinese amber and acid. More recently, it has been suggested that the brilliant luster associated with the Cremona violins is attributable to a fungus that existed in Italy at that time and that affected the chemistry of the wood and/or a varnish applied to the wood. Further discussions of violin finishes are given in the above identified Hill et al work and in "Violin Making: As It Was, And Is" by Ed. Heron-Allen. The disclosure of the prior art identified above is incorporated herein by reference.

None of the finishing methods or compositions described above have received either commercial success or critical acclaim from people skilled in the art of violin making and playing. As a result, the vast majority of violins continue to be finished with spirit based varnishes. These varnish finished violins simply do not approach the visual or acoustical qualities associated with the violins of Stradivari and the other Cremona masters.

Shellac has been available as a coating material since as early as 1300 B.C., where it was used, in one form or another, in southern and southeastern Asia. Shellac is formed from a gum or resin exuded from *Croton* or *Fiscus* species trees indigenous to southern Asia. In particular, the gum is exuded from incisions made by female insects of the *Coccus lacca* species. The gum is soluble in alcohol to yield a transparent or semi-transparent coating. The bodies of these same insects were used to form lac dye which was a coloring medium for wood.

Lac dye is generally unavailable today as a commercial product, and various synthetic dyes are used for coloring mediums. Lac gum, on the other hand, is known to be mixed with an alcohol base to yield a quick drying protective "shellac" coating. White or bleached lac gum is known to provide a protective shellac coating having a high degree of transparency.

Although shellac has been readily available for centuries, it is generally not considered to be an acceptable coating material for fine and valuable wood products. In particular, shellac is known to yield a noticeably imperfect finish in the presence of water. Thus, shellac generally cannot be applied in environments of high humidity. Furthermore, even a fully cured shellac finish does not weather well in the presence of water. For these reasons, shellac is not commercially used for finishing fine pieces of furniture or violins.

In view of the above, it is an object of the subject invention to provide a violin which has aesthetic and acoustical properties similar to or better than the violins crafted in Cremona, Italy, in the seventeenth and eighteenth centuries.

It is another object of the subject invention to provide a method for coating a violin to achieve a deep and brilliant luster and to provide exceptional acoustical characteristics.

A further object of the subject invention is to provide a violin with a deep luster that appears to be generated from within the coating.

Still a further object of the subject invention is to provide a violin with an extremely durable finish.

An additional object of the subject invention is to provide a violin which when hand rubbed will retain its original luster.

Still another object of the subject invention is to provide a method for efficiently coating violins to yield an instrument with enhanced visual and acoustical properties.

SUMMARY OF THE INVENTION

The subject invention is directed to a violin, the exterior of which is coated with plural layers of shellac and at least one color coat. The color coat may be a lac dye in a suitable solvent or a synthetic dye in a solvent of alcohol or spirits, with turpentine being preferred. Preferably, the violin comprises plural coats of white shellac over the color coat. The interior of the violin may also be coated with a sealant, which preferably is one or more coats of a white shellac.

In a preferred embodiment, between two and four base coats of the white shellac are applied to the exterior of the violin. The color coat then is applied over the base coats of white shellac, on all but the neck of the violin. Preferably, the color material is in a spirit solvent. The spirit of the color coat will not interact with the alcohol based shellac base coats initially applied to the violin. As a result, these white shellac base coats will retain their luster and hardness despite the subsequent application of the spirit based color coat. It has been found that the initial 2–4 base coats of white shellac will permit some penetration of the spirit based color coat into the wood, and particularly into the less dense or darkened areas of the wood grain, thereby yielding a desirable array of shading which accents the natural grain pattern of the wood.

After the color coat has been permitted to cure adequately, additional plural layers of white shellac are applied thereto, to define top coats. Preferably, at least approximately 12 additional top coats of white shellac are applied over the color coat.

A final microscopic film of linseed oil may be applied over the last top coat of white shellac to act as a plasticizer to prevent the plural shellac top coats from becoming excessively brittle.

In the preferred method, the one or two coats of sealant, and preferably shellac, are applied first to the interior of the violin. These two interior coats will not yield a visible film on the interior of the violin. From 2 to 4 base coats of white shellac then are applied directly to the wood on the exterior of the violin. Each coat of shellac generally will be dry to the touch in approximately 15 minutes, and will accept a subsequent coat after 30 minutes without the preceding coat being redissolved by the alcohol base of each subsequent coat. The color coat is applied over the initial layers of white shellac, after the last of the initial layers has been permitted to dry for at least one half hour. Preferably the color coat employs a turpentine base and is permitted to dry for approximately one day. After such curing of the color coat, plural top coats of white shellac are applied thereto, with at least one half hour drying time between successive coats. In the preferred embodiment, at least approximately 12 such top coats of white shellac are applied over the color coat.

An alternate preferred violin finishing method includes the first step of drying the raw violin to remove a substantial amount of the moisture from at least the surface of the raw wood. As a next step, a dye or stain is applied to the exterior of the violin. The dye or stain may be applied with an appropriate solvent as a vehicle for application of the dye or stain. After a brief period of drying, the exterior of the violin may be flushed with the solvent to remove portions of the dye or stain from areas of the wood that are generally nonporous, and carrying the stain or dye deeper into more porous areas of the wood. As another step, which may precede or follow the above described stain or dye application, the interior of the dried violin may be coated with shellac or drying oil. Plural coats of an alcohol based finish such as shellac are then applied successively to the exterior of the violin with ample time for drying between successive coats. At least one of the coats of the shellac or other similar finish to be applied to the violin may define a color coat. The color coat, as explained further below, may comprise a saturated solution of powdered gamboge gum in shellac, which imparts a golden hue to the violin. The particular dye or stain selected for the color coat may depend upon the specific color desired for the finished product. Preferably, at least three coats of shellac having a suitable dye therein are applied successively to the exterior of the violin.

A microscopically thin layer of a drying oil, such as boiled linseed oil, may then be applied to the last coat of shellac on the violin. Sufficient drying time is allowed between the application of the last coat of shellac and the microscopically thin layer of oil. The boiled linseed oil may be applied by placing a few drops of the oil on a soft rag and rubbing the rag over the sufficiently dried shellac finish on the violin.

Plural coats of a spirit based finish are then applied to the product. The linseed oil, if applied, is permitted to dry at least approximately ten minutes prior to application of the spirit based finish. The spirit based finish preferably is a varnish, despite the fact that the teaching on most commercially available varnish is that varnish should not be applied to an article having shellac thereon. The plural layers of the spirit based finish preferably comprise a dye and may further comprise an ultraviolet light absorber to prevent fading of the dye in the color coat. In a particularly preferred embodiment, the spirit based coating material comprises a spar varnish with a red dye and an appropriate ultraviolet light absorber therein. Preferably, two or more coats of the spirit based material are applied to the violin, with each coat being allowed to dry to the touch before applying the next coat. A top coat of a drying oil, such as boiled linseed oil may further be applied to the dried spirit based coat.

The resulting product has been found to exhibit superior visual and acoustical properties. In particular, it has been found that light reflecting off the various diverse layers has been found to diffract as it passes through the plural clear top coats of a different material having different refractive characteristics. Additionally, some light will pass through the color coat and will reflect back off the lower coats and the violin to create a visually extraordinary color effect. This unique effect is not found in currently manufactured violins, and resembles the "flame from below" used to describe the unusal and heretofore inimitable effect associated with the violins of Stradivari and other Cremona masters. It has also been found that the violin coated as described herein achieves acoustical effects that are superior to the effects achieved by otherwise identical violins that have been coated with the prior art varnishes and associated methods.

Additionally, the violins as coated herein have been compared to very old violins of the Cremona era. The subject violins with the plural coats of different materials thereon, as described above and further below, have been found to achieve a consistently superior sound despite broad ranges of ambient temperature and humidity which were sufficient to affect the acoustical performance of violins finished in accordance with prior art techniques. These extraordinary results are achieved despite the general belief that shellac is not a suitable coating for quality wood products, such as violins, and despite the explicit teaching of the art that varnishes or similar spirit based coatings should not be applied over shellac.

BRIEF DESCRIPTION OF THE DRAWING

The drawing is a schematic cross-sectional view of a portion of a violin coated in accordance with the subject invention.

DETAILED DESCRIPTION OF THE PREFERRED EMBODIMENT

The violin of the subject invention is indicated generally by the numeral 10 in the accompanying Figure. More particularly, the accompanying Figure depicts a portion of the violin corresponding to the belly, back or sides of the violin. The violin 10 includes a wood substrate 20 which typically is a maple for the back or a pine for the belly or front of the violin. The wood 20 of violin 10 comprises an inwardly facing or interior surface 22 and an outwardly facing or exterior surface 24. The interior surface 22 of the violin 10 is coated with layers 32 and 34 of a white shellac. It has been found that the interior coats protect against atmospheric moisture changes. However, these coats do not form a visible film on the interior of the violin. It has also been found that these interior coats have the extraordinary effect of enhancing the volume and projection of the sound emanating from the violin.

The exterior surface 24 of the violin 10 is first successively coated with coats 42–48 of white shellac to define a base or first layer. The white shellac employed for the coats 42–48 preferably is formed from commercially available shellac dissolved in an alcohol base. The shellac may be formulated to define a concentrated solution of shellac in ethanol or methanol. The preferred shellac solution defined a saturated solution of white shellac flakes in 95% ethanol. In particular, the shellac flakes were thoroughly mixed with the 95% ethanol and then the solution was allowed to stand for at least one hour and remixed. A precipitate of undissolved shellac flakes remained at the bottom, and the supernatant was used for the coating. The white shellac coats 42–48 comprising the first layer may be applied by brush, but other coating techniques are believed to be equally acceptable. From 20 to 60 minutes should be allowed to elapse between successive base coats 42–48 to allow the shellac gum to cure and harden sufficiently to avoid being redissolved by the alcohol base in subsequent base coats 44–48. Generally about 30 minutes has given satisfactory results. Although four base coats are depicted, fewer than four base coats have been tested and found to yield similar visual effects. However, too many base coats may completely prevent the penetration of the color coat into the wood, thereby eliminating the desirable accentuation of the grain.

A color coat 50 comprising a commercially available dye, such as alizarin, is dissolved in turpentine and then is applied to the base coat 48. The alizarin produces a reddish brown color coat. Other available dyes may be employed for different color shades. The color coat may comprise from 0.1% to 2.5% by weight alizarin, and preferably 1.0% of the alizarin in turpentine. The concentration may vary with other dyes and spirits, and in accordance with the desired color effects. The turpentine of the color coat 50 will not dissolve the shellac of base coats 42–48. However, the areas of the wood 20 that are less dense will not be completely sealed by the base coats 42–48. In these areas, the color coat 50 will migrate into and stain the wood 20. In other locations, the color coat 50 will merely provide a coating that will cover but not penetrate the base coats 42–48. The color coat 50 with the turpentine base will require longer to dry before additional coats can be applied. Preferably, the color coat 50 is allowed to dry for one day.

Top coats 60–66 of the above described white shellac are applied to the color coat 50 by substantially the same application method. The alcohol base of the top coats 60–66 will not interact with the color coat 50 provided that sufficient time has elapsed for the color coat 50 to completely dry. In the preferred embodiment, at least twelve top coats of white shellac are applied over the color coat 50, with at least one half hour of drying time between the applications of successive top coats 60–66.

A very fine microscopic plasticizing coat 70 of a drying oil such as boiled linseed oil may be applied to the final top coat 66. Other drying oil may be employed. The oil coat application preferably comprises one or two drops of the oil placed on a soft cloth, and rubbed over the entire violin exterior.

Violins produced as described above and depicted in the accompanying figure have been made and tested both visually and acoustically. The violins have exhibited a brilliant gloss that is not found in currently manufactured violins, and also exhibit superior acoustical characteristics. With respect to the visual characteristics, it has been observed and noted that the lustrous color of the violin 10 described above, appears to be emanating from below the surface. The reasons for the observed visual phenomena are not known. However, without attempting to limit or operationally define the invention, it is believed that these unusual visual characteristics may be attributable to two simultaneous visual phenomena. First, the incident light rays to the color coat 50 may be diffracted as they pass through the plural top coats 60–66. Additionally, the color coat 50 is not opaque, but rather translucent to permit light rays to pass therethrough. The light rays passing through the color coat 50 may reflect off the base coats 42–48 and may be retransmitted through the color coat 50 and the top coats 60–66, with additional diffraction of the light rays.

Over 260 unfinished violins were purchased from a single source in Mittenwald, Germany, for experimentation that led to the violin and method disclosed herein. Visually striking and acoustically fine violins were made by applying the above described turpentine based color coat directly to the wood of the violin, and applying the white shellac top coats thereto. However, visually superior violins were achieved when the base coats of white shellac 42–48 were applied to the exterior surface 24 of violin 10 prior to applying the color coat 50. Similar visual effects with different color variations were achieved by applying additional color coats similar to the color coat 50 interspersed between plural layers of the top coats 60–66. These violins were compared with violins purchased from the same source and coated with the prior art varnishing techniques. The visual results and differences were unexpected and striking. Furthermore, violins coated as depicted in the Figure, or in the slight variations thereto as described above, were noted to achieve a greater acoustical fullness and brilliance and a distinctly mellow reediness. The instruments were also very responsive to the bow.

Violins which achieve visual and acoustical performance at least as good as those described in the preceding paragraphs have been made by first drying the raw violin in dry heat of 90° or more for at least 24 hours. The drying can be significantly enhanced by first flushing the violin with an organic solvent that is immiscible with water vapor, such as turpentine. The drying of the raw violin removes significant amounts of moisture from the wood at least adjacent the surfaces thereof.

A dye or pigment is then applied to the dried violin using an appropriate solvent as a vehicle. The dye or pigment preferably is of a red, orange or brown hue, with an ochre artist's pigment providing a desirable visual effect. The solvent preferably is turpentine or boiled linseed oil and is applied very liberally using a soft rag. As a result, most of the dye or pigment is rinsed from the less porous areas of the wood, but is carried deeper into the more porous areas. After application of the dye or pigment with the solvent, the violin is placed in an area of dry heat to prevent any significant reabsorption of water vapor.

Between three and ten coats of shellac are then applied successively to the exterior of the violin and at least one coat of shellac to the interior of the violin, with at least one half hour of drying time between successive coats. Each coat of the shellac is formed as described above from a commercially available shellac. In particular, the shellac is formulated to define a concentrated solution of shellac in ethanol or methanol. The preferred shellac solution for this method, as for the previously described method, defines a saturated solution of white shellac flakes in 95% ethanol. The shellac flakes were thoroughly mixed with the 95% ethanol, and then the solution was allowed to stand for at least one hour and remixed. A precipitate of undissolved shellac flakes remained at the bottom.

A powdered gamboge gum was then mixed with the saturated shellac solution. The gamboge gum defines the preferred dye for coloring the violin, and the concentration of the gamboge in the shellac would be determined by the desired coloration of the violin. In the preferred embodiment, the gamboge was mixed with the shellac solution to achieve saturation of the powdered gamboge gum therein.

At least three coats of the shellac and gamboge solution were applied to the exterior of the violin to achieve both the striking visual effects and the superior acoustical performance. The most preferred violins were provided with between nine and ten coats of the shellac solution on the exterior of the violin to provide a brilliant deep golden hue with significant tonal variations. As part of or prior to application of at least the first coat of shellac solution to the exterior of the violin, a sufficient amount of the solution was poured through the f-holes to completely coat the interior of the violin. The visual appearance of the violin interior of course is unimportant. However, violins having one or two interior coats of the shellac solution exhibited enhanced acoustical clarity and projection.

A microscopically thin layer of boiled linseed oil was applied to the last coat of the shellac and gamboge solution, after the shellac and gamboge solution was allowed to dry at least one hour. A few drops of the boiled linseed oil was applied to a soft cloth and was rubbed over the surface of the dried shellac solution. The microscopically thin layer of boiled linseed oil was allowed to dry approximately ten minutes.

At least one coat of a spar varnish having an ultraviolet light absorber and a red dye such as the above mentioned alizarin therein was applied to the exterior of the violin. The ultraviolet light absorber sold by American Cyanamid Company under the name CYASORB UV-24 was found effective when mixed with a commercial brand of spar varnish. In other experiments, a spar varnish such as McClosky's spar varnish with an ultraviolet light absorber premixed in the commerical product was also employed with comparable results. The preferred varnish mixture comprised 140 cc of the commercial varnish mixture with the ultraviolet light absorber therein. To this was added 20 cc of boiled linseed oil saturated with powdered alizarin and approximately 5–10 cc turpentine. The varnish solution was permitted to dry to the touch between successive coats on those violins with more than one coat of varnish solution.

It should be noted that the commercial varnishes used in these experiments included prominent legends on their labels that the varnish was not to be applied to products that were previously coated with shellac. Despite this teaching, it has been found that the resulting violin provides the superior visual effects described with respect to the previous embodiment. The visual effect has been described as "a fire from below" due to the visual impression that the glowing color originates from a location well below the surface of the violin. This visual effect is believed to be due to the fact that the different colors in the otherwise transparent shellac and varnish solutions reflects and refracts in all directions through the plural coats. Additionally, as with the previously described embodiment, the existence of different light refractive characteristics in the various coats (e.g. shellac versus varnish) appear to alter the light refraction of these coats, to provide the clearly astounding visual effects that have been observed. The initial application of the dye or pigment washed liberally with the solvent also contributes to significant color tonal variations across the violin in accordance with porosity of the wood.

In addition to the above described visual effects, the violins made in accordance with this preferred embodiment were tested extensively for acoustical performance by accomplished violinists, and were compared to many prior art violins by persons skilled in the violin art, including extremely expensive violins crafted and finished in Cremona hundreds of years ago. The violins against which the subject violin were compared included an Amati violin believed to have been manufactured in the late 17th century and to a Guadagnini violin made in Cremona in the 18th century. Violins made in accordance with the above described preferred method were consistently acoustically better than violins made recently in accordance with prior art methods. Furthermore, the subject violins were found to be acoustically comparable to the Cremona violins. The violins finished in accordance with this preferred method were found to have consistently desirable projection during broad ranges of temperature and humidity conditions that were found to notably affect the acoustical consistency of the prior art violins including the Cremona violins.

In summary, a violin with enhanced visual appearance and acoustical performance is provided by applying a pigment to the exterior of a dried violin and coating the exterior surface with plural coats of white shellac with a dye medium therein. Preferably, between three and ten base coats of white shellac with the dye dissolved therein are initially applied to the exterior of a dry violin. Plural top coats of a spirit based coating are applied to the dried coats, with a microscopically thin coat of boiled linseed oil optionally being applied therebetween. The top coats preferably define a spar varnish with an ultraviolet light absorber and a dye therein. Shellac may also be applied to the interior of the violin to further enhance acoustical clarity and projection and to minimize effects of atmospheric changes on the performance of the violin.

While the invention has been described with respect to certain preferred embodiments, it is apparent that various changes can be made without departing from the scope of the invention as defined by the appended claims.

I claim:

1. A wood violin having a multi-layer finish comprising as the first layer a pigment applied to the exterior surface of the violin, as a second layer plural coats of an alcohol based finish having a dye dissolved therein, and as a third layer at least one coat of a spirit based finish having a dye dissolved therein.

2. A violin as in claim 1 further comprising at least one coat of an alcohol or oil based finish applied to the interior of said violin.

3. A violin as in claim 1 further comprising as an intermediate layer a coat of a drying oil between the second and third layers.

4. A violin as in claim 1 wherein said first layer comprises between three coats and ten coats of shellac.

5. A violin as in claim 1 wherein the first layer is provided by a white shellac comprising a shellac gum dissolved in an alcohol base and the dye.

6. A violin as in claim 1 wherein the spirit based finish defining the third layer comprises a varnish having an ultraviolet light absorber therein.

7. A violin as in claim 1 wherein the dye in the second layer is a powdered gamboge gum.

8. A violin as in claim 1 wherein the first layer further comprises an organic solvent as a vehicle for the pigment.

9. A violin as in claim 1 wherein the dye in the third layer is alizarin.

10. A wood violin having an exterior surface with a multi-layer finish comprising as the first layer a pigment and an organic solvent as a vehicle for the pigment; as a second layer, between three and ten coats of white shellac having a gamboge dye dissolved therein; as a third layer a coat of boiled linseed oil and as a fourth layer at least one coat of varnish having an ultraviolet light absorber and a dye therein, said violin further comprises an interior surface, said interior having at least one coat of an alcohol or oil based finish.

11. A violin as in claim 10 wherein the coat of finish on the interior of the violin comprises shellac.

12. A violin as in claim 10 wherein the second layer comprises nine or ten coats.

13. A violin as in claim 10 wherein the dye in the fourth layer is alizarin.

14. A method for finishing a wooden violin, said method comprising the steps of: forming a first layer on the exterior surface of the violin by applying a pigment thereto with an organ solvent as a vehicle for the pigment; forming a second layer by applying a plurality of coats of white shellac with a dye dissolved therein; and forming a third layer by applying at least one coat of varnish with a dye therein over said third layer.

15. A method as in claim 14 wherein the interior surface of said violin is coated applying at least one coat of an alcohol or oil based finish to said interior surface.

16. A method as in claim 14 wherein the step of applying said second layer to the exterior of the violin comprises applying between three and ten coats of white shellac successively with the dye dissolved therein, and allowing each of said coats to dry before applying the next successive coat.

17. A method as in claim 14 wherein said third layer comprises varnish having an ultraviolet light absorber therein.

18. A method as in claim 14 further comprising applying a layer of drying oil between the second and third layers.

19. A method as in claim 14 further comprising a first step of drying the wood violin prior to applying the layer of finish thereto.

20. A method as in claim 19 further comprising applying a solvent that is immiscible with water to the violin as part of the drying step.

21. A method as in claim 14 wherein the white shellac of said first layer comprises a saturated solution of white shellac flakes in 95% ethanol.

22. A method as in claim 21 wherein the dye is a powdered gamboge gum dissolved to saturation in the saturated shellac solution.

23. A method as in claim 14 wherein the dye in the third layer is alizarin.

* * * * *